US006484695B1

(12) United States Patent
Cobb, Jr.

(10) Patent No.: US 6,484,695 B1
(45) Date of Patent: Nov. 26, 2002

(54) ENGINE HAVING COMPRESSED AIR ASSISTED INJECTION WITH SECONDARY HIGH SPEED FUEL CARBURETOR SANDWICH

(75) Inventor: William T. Cobb, Jr., St. Petersburg, FL (US)

(73) Assignee: Design & Manufacturing Solutions, Inc., Tampa, FL (US)

( * ) Notice: Subject to any disclaimer, the term of this patent is extended or adjusted under 35 U.S.C. 154(b) by 0 days.

(21) Appl. No.: 09/533,752

(22) Filed: Mar. 23, 2000

Related U.S. Application Data

(60) Provisional application No. 60/125,819, filed on Mar. 24, 1999.

(51) Int. Cl.[7] ..... F02M 11/00

(52) U.S. Cl. ..... 123/438; 123/442; 123/584; 261/41.3

(58) Field of Search ..... 123/584, 438, 123/442, 73 C; 261/41.1, 41.2, 41.3

(56) References Cited

U.S. PATENT DOCUMENTS

| | | | | | |
|---|---|---|---|---|---|
| 4,037,571 | A | * | 7/1977 | Ishida | 123/584 |
| 4,248,185 | A | * | 2/1981 | Jaulmes | 123/DIG. 4 |
| 4,253,433 | A | * | 3/1981 | Blair | 123/DIG. 4 |
| 4,261,304 | A | * | 4/1981 | Yamada | 123/584 |
| 4,333,429 | A | * | 6/1982 | Iiyama et al. | 123/584 |
| 4,384,559 | A | * | 5/1983 | Tchang et al. | 261/41.3 |
| 4,796,579 | A | * | 1/1989 | Wolfe et al. | 123/442 |
| 4,870,990 | A | * | 10/1989 | Bierling et al. | 261/41.3 |
| 5,845,677 | A | * | 12/1998 | Kim | 123/584 |

* cited by examiner

*Primary Examiner*—Erick Solis
(74) *Attorney, Agent, or Firm*—Harrington & Smith, LLP

(57) ABSTRACT

An internal combustion engine having a crankcase, a cylinder connected to the crankcase, a compressed air assisted fuel injection system connected between the crankcase and the cylinder, and a reciprocating piston head located in the cylinder. The improvement comprises a fuel delivery system having two carburetor sections with two interconnected rotatable shafts.

16 Claims, 6 Drawing Sheets

ENGINE HAVING COMPRESSED AIR ASSISTED INJECTION WITH SECONDARY HIGH SPEED FUEL CARBURETOR SANDWICH

CROSS-REFERENCE TO RELATED APPLICATION

This application claims the benefit of U.S. provisional patent application Ser. No. 60/125,819 filed Mar. 24, 1999.

BACKGROUND OF THE INVENTION

1. Field of the Invention

The present invention relates to internal combustion engines and, more particularly, to a carburetor having two control shafts.

2. Prior Art

The present invention relates to fuel injection systems for internal combustion engines and, more specifically, to the control of a low pressure injection in an internal combustion engine. A particular field of application of the invention is a two-stroke internal combustion engine. The specific application described is to a small high speed two-stroke engine, such as utilized in handheld power equipment such as leaf blowers, string trimmers and hedge trimmers, also in wheeled vehicle applications such as mopeds, motorcycles and scooters, and in small outboard boat engines. The small two-stroke engine has many desirable characteristics, that lend themselves to the above applications, including: simplicity of construction, low cost of manufacturing, high power-to-weight ratios, high speed operational capability and, in many parts of the world, ease of maintenance with simple facilities.

The prominent drawback of the simple two-stroke engine is the loss of a portion of the fresh unburned fuel charge from the cylinder during the scavenging process. This leads to poor fuel economy and, more importantly, high emission of unburned hydrocarbon, thus rendering the simple two-stroke engine incapable of compliance with increasingly stringent governmental pollution restrictions. This drawback can be relieved by separating the scavenging of the cylinder, with fresh air, from the charging of the cylinder, with fuel. This separation can be achieved by injecting the liquid fuel into the cylinder or more preferably by injecting the fuel charge by utilizing a pressurized air source, separate from the fresh air scavenge, to spray the fuel into the cylinder. In a preferred embodiment of the present invention, the displacement size of the engine is about 16 cc to about 100 cc, but could be larger or smaller. These sizes of engines are used for such things as string trimmers, chain saws, leaf blowers, and other hand held power tools. The engine could also be used on a tool such as a lawn mower, snow blower or motor boat outboard engine.

SUMMARY OF THE INVENTION

In accordance with one embodiment of the present invention, an internal combustion engine is provided having a crankcase, a cylinder connected to the crankcase, a compressed air assisted fuel injection system connected between the crankcase and the cylinder, and a reciprocating piston head located in the cylinder. The improvement comprises a fuel delivery system having two carburetor sections with two interconnected rotatable shafts.

In accordance with another embodiment of the present invention, an internal combustion engine carburetion system is provided comprising a frame having two air flow channels; two throttle shaft assemblies connected to the frame and extending into respective ones of the air flow channels; and a movement system for moving the two throttle shaft assemblies.

In accordance with one method of the present invention, a method of assembling a carburetor for an internal combustion engine is provided comprising steps of providing a frame having two air flow channels through the frame, the frame having a fuel conduit system for supplying fuel to the two air flow channels; connecting two control shaft assemblies to the frame, a first one of the shaft assemblies extending into a first one of the air flow channels; and operably connecting the two control shaft assemblies to each other to coordinate movement of a second one of the shaft assemblies at least partially relative to movement of the first shaft assembly. Movement of the second shaft assembly at least partially controls supply of fuel delivery to a second one of the air flow channels, and wherein movement of the first shaft assembly from a first idle position to a second wide open throttle position has a coordinated movement of the second shaft assembly from a first small or no fuel supply delivery position to the second air flow channel to a second relatively larger fuel supply delivery position with fuel delivery being switched, at least partially, from the first air flow channel to the second air flow channel when the two control shafts are moved between their respective first and second positions.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

Figure 1C:
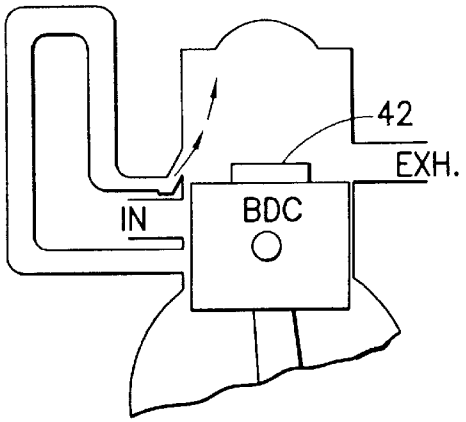
FIGS. 1A–1E are partial schematic diagrams of an engine incorporating features of the present invention with the piston head at various different operational positions.
Figure 1B:
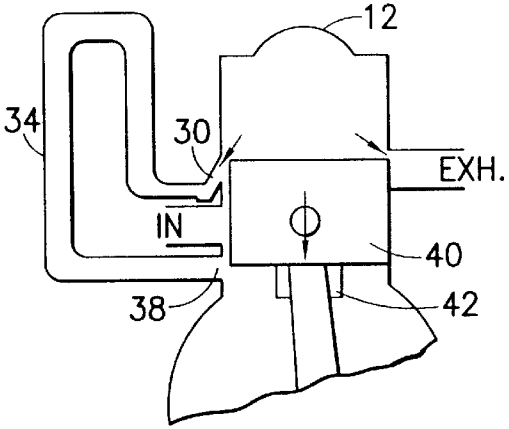
Figure 1E:
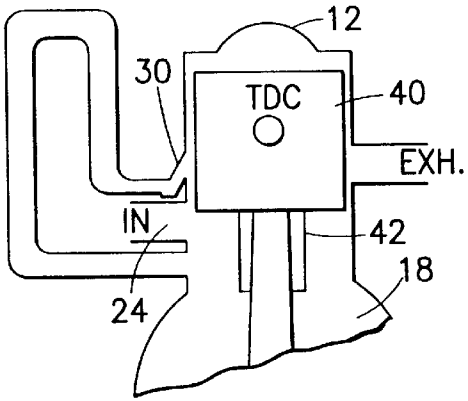
Figure 1A:
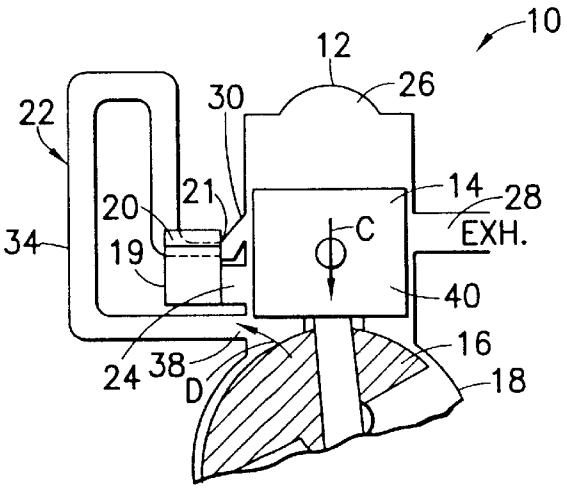

Referring to FIG. 1A, there is shown a schematic view of an internal combustion engine 10 incorporating features of the present invention. Although the present invention will be described with reference to the embodiments shown in the drawings, it should be understood that the present invention can be embodied in many alternate forms of embodiments.

In addition, any suitable size, shape or type of elements or materials could be used.

The engine 10 is a two-stroke engine having a cylinder 12, a piston 14, a crankshaft 16, a crankcase 18, and a fuel delivery system 22 having a first carburetor 19, a second carburetor 20 and an accumulator 34. The present invention relates to the control of a low pressure injection in an internal combustion engine. A particular field of application of the invention is a two-stroke internal combustion engine. The specific application described is to a small high speed two-stroke engine, such as utilized in handheld power equipment such as leaf blowers, string trimmers and hedge trimmers, also in wheeled vehicle applications such as mopeds, motorcycles and scooters and in small outboard boat engines. The small two-stroke engine has many desirable characteristics that lend themselves to the above applications including: simplicity of construction, low cost of manufacturing, high power-to-weight ratios, high speed operational capability and, in many parts of the world, ease of maintenance with simple facilities.

The prominent drawback of the simple two-stroke engine is the loss of a portion of the fresh unburned fuel charge from the cylinder during the scavenging process. This leads to poor fuel economy and, most importantly, high emission of unburned hydrocarbon, thus rendering the simple two-stroke engine incapable of compliance with increasingly stringent governmental pollution restrictions. This drawback can be relieved by separating the scavenging of the cylinder, with fresh air, from the charging of the cylinder with fuel. This separation can be achieved by injecting the liquid fuel into the cylinder, or more preferably by injecting the fuel charge, by utilizing a pressurized air source, separate from the fresh air scavenge, to spray the fuel into the cylinder. This type of method is disclosed in U.S. patent application Ser. No. 09/138,244 filed Aug. 21, 1998 which is hereby incorporated by reference in its entirety. In a preferred embodiment of the present invention, the displacement size of the engine is about 16 cc to about 100 cc, but could be larger or smaller. These sizes of engines are used for such things as string trimmers, chain saws, leaf blowers, and other hand held power tools. The engine could also be used on a tool such as a lawn mower, snow blower or motor boat outboard engine. The cylinder 12 has a spark plug (not shown) connected to its top, a bottom which is connected to the crankcase 18, an inlet 24 connected to the first carburetor 19, a combustion chamber 26, an exhaust outlet 28, and an injection port or inlet 30 into the combustion chamber. An advantage of the present system is that there is no need for high precision timing or spray quality for the fuel delivery system. A relatively simple metering system that delivers drops of fuel can be used. In the embodiment shown in FIG. 1A the injection port 30 is an open type of port; i.e.: with no flow check valve into the combustion chamber 26. However, an alternate embodiment could be provided which has a flow check valve at its injection port, such as disclosed in U.S. patent application Ser. No. 09/065,374 which is hereby incorporated by reference in its entirety. However, any suitable check valve could be used. The injection port 30 is located in a side wall of the cylinder 12 and is shaped to input fuel and air in an upward direction towards the top of the cylinder head. However, in alternate embodiments the inlet 30 could be located in the top of the cylinder head or be shaped to direct fuel towards the top of the piston 14.

The fuel delivery system 22 is a compressed air assisted system. The accumulator 34, in this embodiment, has an inlet 38 connectable to pressure inside the crankcase 18 and an exit at the injection port 30. The accumulator 34 functions as a collector and temporary storage area for compressed air. In this embodiment the source of the compressed air is air scavenged from the crankcase 18. The piston 14 compresses the air in the crankcase 18 on the piston's downward stroke. In a preferred embodiment the two apertures 30, 38 are both provided in the cylinder 12; one above the inlet 24 and one below the inlet 24. In the preferred embodiment both apertures 30, 38 are piston ported. In other words, the piston head 40 is sized and shaped to open and close access through the apertures 30, 38 as the piston head 40 reciprocates up and down in the cylinder 12. The accumulator 34, in this embodiment, is a simple channel between the two apertures 30, 38. However, in alternate embodiments more complicated shapes could be provided. The channel 34 could be partially machined into an exterior surface of the cylinder 12 with a cap then being attached to the cylinder to form and enclose the channel 34 with only the two apertures 30, 38. However, the accumulator could be provided in a separate member attached to the cylinder 12 such as disclosed in U.S. patent application Ser. No. 09/518,578 filed Mar. 3, 2000 which is hereby incorporated by reference in its entirety. In the preferred embodiment an exit 21 from the secondary carburetor 20 is located in the channel 34 proximate the injection port 30.

The accumulator 34 uses the piston head 40 to open and close its ports 30, 38. Timing of the opening and closing of the ports 30, 38 will be dependent upon location of the ports along the length of the cylinder 12. Referring to FIGS. 1A–1E the operation of the delivery system will now be described. The carburetors 19 and 20 are not shown in FIGS. 1B–1E merely for the sake of clarity. FIG. 1A shows the piston head 40 at about 90° ATDC (after top dead center) moving downward in the cylinder 12 as shown by arrow C away from the top dead center position of the piston head. The piston head 40 is blocking the inlet 30, the exhaust outlet 28 and the air inlet 24, but the aperture 38 is open. With the piston head 40 moving towards the crankcase 18, air from inside the crankcase 18 is pushed into the accumulator 34 through the aperture 38 as indicated by arrow D. As the piston head 40 moves towards the position illustrated in FIG. 1B, the aperture 30 is beginning to be opened, as the piston head 40 uncovers the aperture 30, and the aperture 38 is beginning to be closed, as the piston head 40 starts to block the aperture 38. The piston head uncovers the inlet 30 at about 115° of rotation of the crankshaft after TDC (ATDC). In this embodiment the piston head 40 completely closes the aperture 38 at about the same time the piston head opens access to the transfer channel 42 (see FIG. 1C) when the transfer 42 opens. The aperture 38 is effectively closed by the piston head 40 substantially entirely while the aperture 30 is open.

Figure 1D:
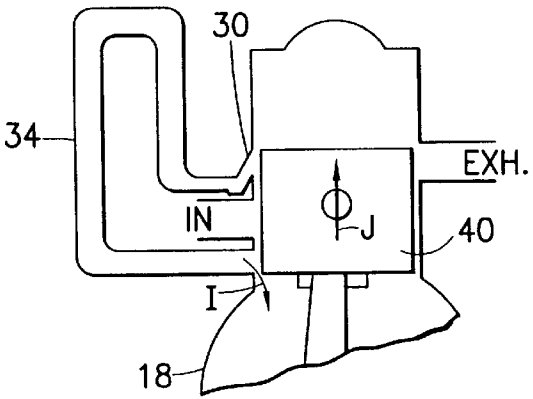

The present invention uses the accumulator 34 and the secondary carburetor 20 to deliver air and fuel to the combustion chamber similar to that described in U.S. patent application Ser. No. 09/138,244 by vacuum pulling fuel from the carburetor 20 into the accumulator 34, using compressed air from the crankcase 18 into the accumulator 34, and using a reflected compression wave in the accumulator 34. As the reflected compression wave in the accumulator 34 exits the inlet 30 it causes the fuel and air in the cylinder 12 to be greatly disturbed; in effect functioning as a shock wave. This helps to atomize the fuel and distribute the fuel better in the air. In addition, the reflected compression wave assists in removing fuel droplets that might be adhering to tips or edges of the inlet 30 by surface adhesion or surface tension. The compression wave shocks the fuel off of the surface and into the cylinder 12. The compressed air continues to push out the inlet 30 until the inlet is closed by the piston head again as shown in FIG. 1D. The residual air in the accumulator 34 after the inlet 30 is closed, just after 1D, may still be pressurized. The inlet 30 completely closes shortly before the exhaust outlet 28 is closed. The aperture 38 opens at substantially the same time the aperture 30 is closed. However, in alternate embodiments opening of the aperture 38 could be configured to occur before the aperture 30 is closed or, alternatively, after the aperture 30 is closed. The opening of the aperture 38 may function as a blow off port to relieve residual pressure from the compressed air in the accumulator 34 back into the crankcase 18 as shown by arrow I in FIG. 1D. Relieving pressure from the accumulator 34 when the inlet 30 is closed prevents an excessive amount of fuel from being pushed between the piston head 40 and the inside cylinder wall that could otherwise raise hydrocarbon emissions.

With the piston head 40 rising as shown by arrow J in FIG. 1D towards the TDC position, crankcase pressure drops below 1 atmosphere. Thus, when aperture 38 is opened, not only is pressure in the accumulator 34 relieved, but a vacuum pressure is created in the accumulator 34. This vacuum pressure is used to pull fuel from the second carburetor 20 through inlet 21 into accumulator 34 and, thus, assist in delivering fuel into the accumulator. Referring also to FIG. 1E the piston head 40 is shown at its TDC position. The inlet 24 was opened. The first carburetor 19 introduces a fuel/air mixture into the crankcase 18 from the inlet 24.

Figure 2:
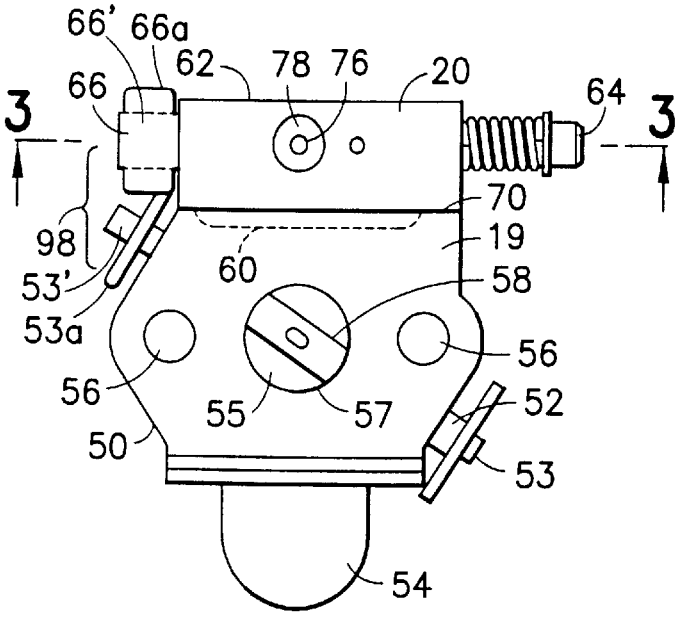
FIG. 2 is an elevational side view of the carburetors shown in FIG. 1A.

Referring now to FIG. 2, the two carburetors 19, 20 are shown. The two carburetors 19, 20 could be formed in a single carburetor frame member. The first carburetor 19 could also merely be a combined air throttle and lubrication system for the crankcase in a two stroke engine. In the embodiment shown, the first carburetor 19 comprises a carburetor body 50, a throttle shaft assembly 52, and a purge bulb 54. The carburetor body 50 has holes 56 for mounting the body to the cylinder 12 and a through channel 57 with an air inlet 58. An air filter (not shown) would be connected to the inlet 58. The opposite end of the through channel 57 is connected to the inlet 24. The throttle shaft assembly 52 has a rotatable shaft 53 with a throttle plate 55 located in the through channel 57. The body 50 also has an area 60 which forms a fuel metering chamber.

Figure 3:
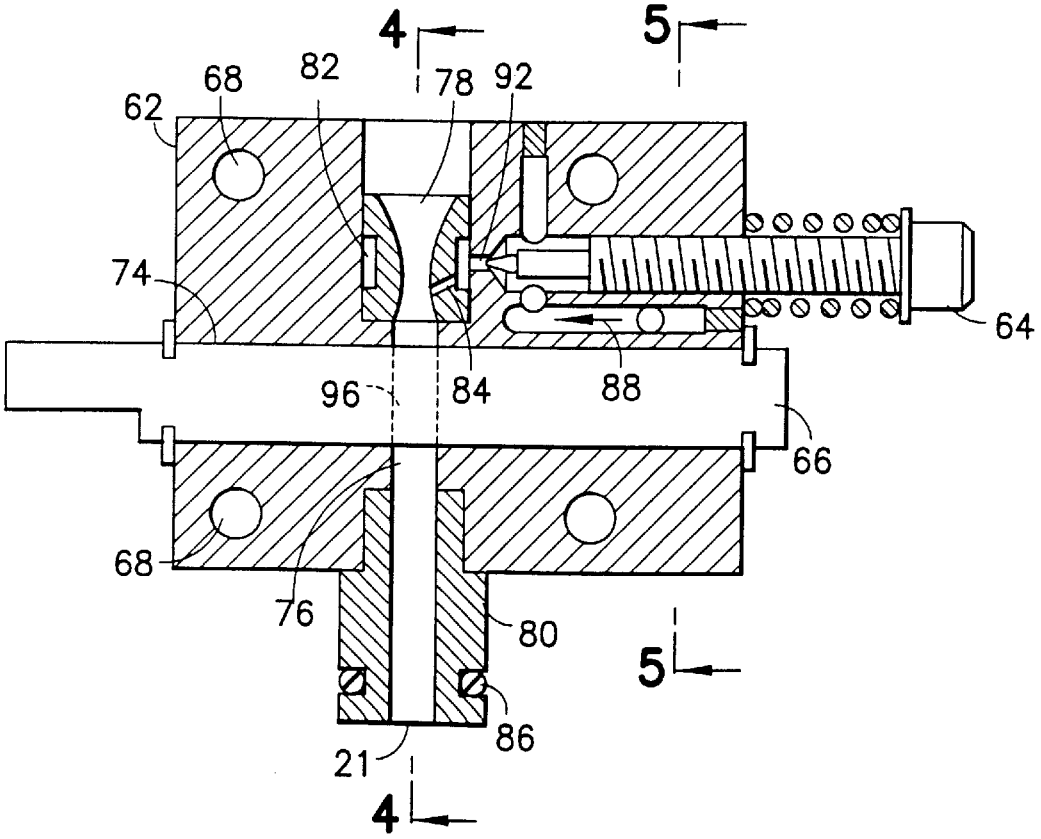
FIG. 3 is a cross-sectional view taken along line 3—3 in FIG. 2.
Figure 4:
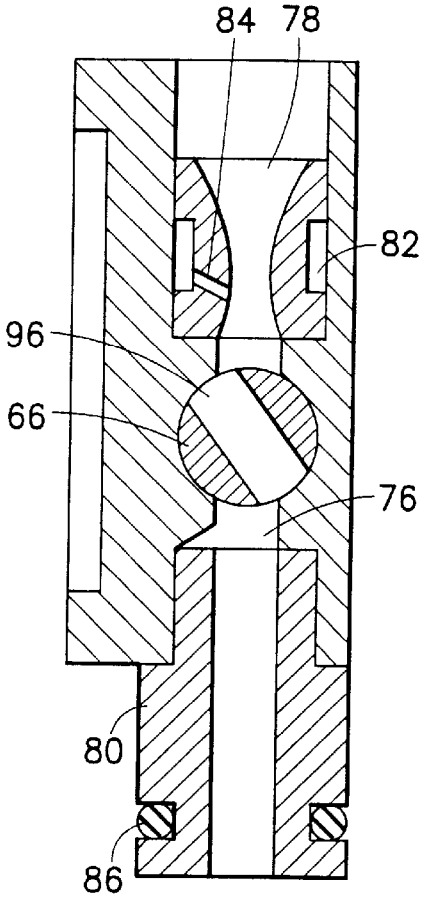
FIG. 4 is a cross-sectional view taken along line 4—4 in FIG. 3.
Figure 5:
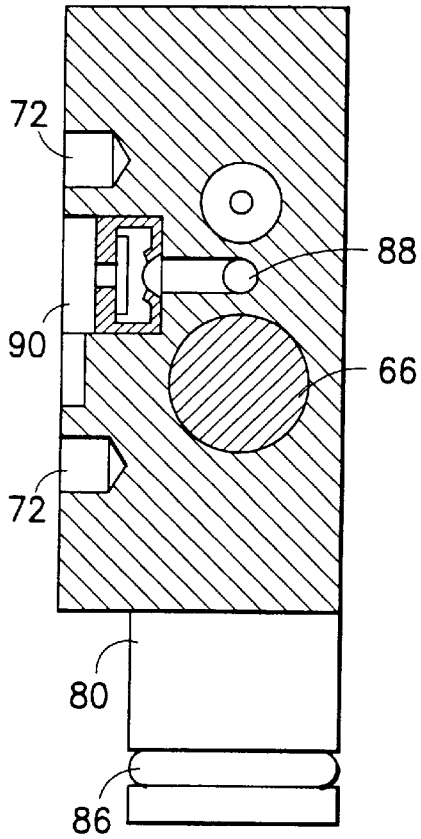
FIG. 5 is a cross-sectional view taken along line 5—5 in FIG. 3.

The second carburetor 20 comprises a frame 62, a fuel metering screw 64, and a secondary throttle shaft 66. Referring also to FIGS. 3, 4 and 5, the frame 62 preferably has holes 68 for fasteners (not shown) to fasten the frame 62 against a side 70 of the carburetor body 50 of the first carburetor 19. The side 70 has the metering chamber 60 formed therein. The frame 62 can also have holes 72 (see FIG. 5) to receive pins (not shown) extending from the side 70 to align the two frames 50, 62 with each other. The frame 62 has a channel 74 which the shaft 66 is rotatably mounted in. The frame 62 has an intersecting channel 76. A venturi member 78 is mounted in one end of the channel 76 and a fitting 80 is mounted in the other end of the channel 76. Venturi member 78 could be integrally formed with the frame 62. The venturi member 78 has an annular recess 82 and a fuel flow channel 84 into its center pathway. The fitting 80 extends from the frame 62 and has an O-ring seal 86. The fitting 80 and the inlet 21 are intended to extend into accumulator 34 near the inlet 30. The frame 62 has a fuel supply conduit system 88 from area 90 to area 92. Area 90 is located adjacent the area 60 of the main carburetor body 50. A check valve 94 is located in area 90. The fuel metering screw 64 is located in the conduit system 88 with its needle tip at area 92. The secondary throttle shaft 66 has a transverse through hole 96. As noted above, the shaft 66 is rotatably mounted in the frame 62. Thus, the hole 96 can be rotated into and out of alignment with channel 76. A connection 98 (see FIG. 2) is provided between ends of the two shafts 66, 52 such that, when shaft 52 is rotated the shaft 66 can be caused to be rotated. In the embodiment shown in FIG. 2 the connection 98 generally comprises the two ends 53' and 66' being directly connected to each other by gears 53*a*, 66*a*. rotation of shaft 53 causes the gears 53*a* to rotate. Gear 53*a* is intermeshed with gear 66*a*. Thus, rotation of gear 53*a* causes gear 66*a* to rotation. Rotation of gear 66*a* causes shaft 66 to rotate. The gears 53*a* and 66*a* can be selected with any suitable shapes, diameter sizes, and/or teeth configurations to provide any suitable pattern of angular rotations of the two shafts 53, 66 relative to each other. For example, shaft 53 could rotate a predetermined amount of degrees without shaft 66 rotating (or vise versa) and/or relative proportions of degrees of rotations of the shafts 53, 66 could be other than 1:1 and/or could be variable. In addition, any suitable mechanical connection could be provided between the two shafts 53, 66 to somehow link movement of one shaft, at least partially, relative to the other shaft.

In the idle position the throttle plate 55 substantially blocks or limits the passage of air through the main channel 57. Also in the idle position, the hole 96 is not aligned with the secondary channel 76. Thus passage of air through the channel 76 is prevented or substantially prevented. The throttle shaft assembly 52 can be rotated about 70–90 degrees to a wide open throttle (WOT) position. In the WOT position, the throttle plate 55 is moved to a position generally parallel to the axis of the main channel 57 such that the main channel 57 is substantially open to allow air to relatively freely pass therethrough. Also in the WOT position, the hole 96 is aligned with the secondary channel 76 to allow air to pass therethrough.

The present invention uses the second carburetor 20 to deliver the majority of fuel for combustion in the combustion chamber 26 for all speeds of the engine. With the throttle shaft assembly 52 in the idle position, the hole 96 is only slightly aligned with the channel 76. Thus, the quantity of fuel which can pass from channel 84, through hole 96, and out the inlet 21 is kept small. Fuel, which includes some oil, is also delivered from the metering chamber 60 to the main air channel 57. The carburetor preferably has a diaphragm driven metering device in the metering chamber 60. In a preferred embodiment the fuel delivery into the main air channel 57 is controlled by vacuum suction of the fuel/oil mixture into the channel 57 wherein a venturi is located upstream from the fuel/oil mixture entrance into the channel 57. At wide open throttle more fuel is sucked into the channel 57 than at idle because the vacuum pull in the channel 57 is larger at wide open throttle than at idle.

However, the quantity of fuel being delivered to the main air channel 57, even at idle, is kept very small and is not intended to account for a significant percentage of the fuel to be combusted in the combustion chamber 26. Instead, the primary reason the fuel/oil is delivered to the main air channel 57 is for introduction into the crankcase 18 to lubricate the piston 14 and components in the crankcase 18. The main air channel 57 merely provides a convenient means to deliver this lubrication. Of course, some of the fuel delivered to the crankcase 18 through the main air channel 57 will contribute to combustion. However, delivery of fuel to the crankcase 18 is preferably kept as small as possible to thereby limit wasteful loss of unburned fuel out the exhaust 28 and resultant higher hydrocarbon emissions. The primary function of the main air channel 57 is to deliver air (not fuel) into the crankcase with the additional optional function of delivering a lubricant to the components in the crankcase.

As the carburetors 19, 20 are moved to their wide open throttle positions the shafts 53, 66 are rotated about 70–90 degrees. As the secondary throttle shaft 66 is rotated the hole 96 moves more and more into registry with the channel 76. Thus, more fuel can pass through the hole 96 and out the inlet 21. The shaft 53 is also rotated to move the plate 55 and allow more air to pass through the main air channel 57. As the main carburetor 19 moves from idle towards WOT, more fuel/oil (to act as a lubricant in the crankcase 18) is introduced into the channel 57. Thus, lubrication is supplied in proportion to the load/speed of the engine (predominantly load); more lubricant at high load/speed and less lubricant at idle.

In an alternate embodiment the carburetors 19, 20 could be configured to substantially switch roles of being the majority fuel contributors for combustion. For example, the shaft 66 and hole 96 could be configured to entirely close or block the channel 76 at the idle position. Therefore, no fuel is delivered to the combustion chamber 26 from the channel 76 and inlet 21. In the idle position fuel is only delivered by the main channel 57, via the inlet 24, crankcase 18 and channel 42, to the combustion chamber 26. The first carburetor 19 would need to be configured to be the primary source of fuel for combustion at idle speed, preferably based upon vacuum pull from vacuum in the main air channel 76. When the shaft 52 is rotated to the wide open throttle (WOT) position fuel is delivered to the accumulator 34 by the second carburetor 20. In particular, fuel is vacuum pulled through the conduit system 88, into the secondary channel 76, through the hole 96, through the inlet 21 and into the accumulator 34. Because plate 55 is at an open position, the line from the fuel metering device at 60 into channel 57 is exposed to significantly less vacuum pull. The channel 57 could have a small venturi or no venturi at all. Thus, significantly less fuel is delivered to the main air passage 57 at the wide open throttle position than at idle. Almost all the fuel is delivered to the secondary channel 76. Thus, the present invention could switch fuel delivery between the main channel 57 at idle and the secondary channel 76 at wide open throttle. At wide open throttle a small amount of fuel/oil will pass through the main air passage 57 to lubricate the components in the crankcase 18. During wide open throttle the vacuum in secondary channel 76 starves the channel 57 of most fuel. A smooth transition is provided as the fuel delivery system switches between idle and wide open throttle conditions. During wide open throttle almost pure air is entering inlet 24 into the crankcase 18. The engine 10 could have an additional or alternative lubrication system. In another alternate embodiment, the percentages and ratios of delivery of fuel by the two carburetors 19, 20 intended to be combusted in the combustion chamber 26 could be variably configured based upon a range of speeds of the engine. However, the second carburetor 20 preferably delivers over 90% of the fuel to be combusted at the WOT speed. With the present invention a carburetor can be assembled by first providing a frame having two air flow channels through the frame. The frame can comprise a fuel conduit system for supplying fuel to the two air flow channels. Two control shaft assemblies can be connected to the frame. A first one of the shaft assemblies would extend into a first one of the air-flow channels. The two control shaft assemblies can then be operably connected to each other to coordinate movement of a second one of the shaft assemblies, at least partially, relative to movement of the first shaft assembly. Movement of the second shaft assembly would at least partially control supply of fuel delivery to a second one of the air flow channels. Movement of the first shaft assembly from a first idle position to a second wide open throttle position has a coordinated movement of the second shaft assembly from a first small or no fuel supply delivery position with fuel delivery being switched, at least partially, from the first air flow channel to the second air flow channel when the two control shafts are moved between their respective first and second positions.

Figure 6:
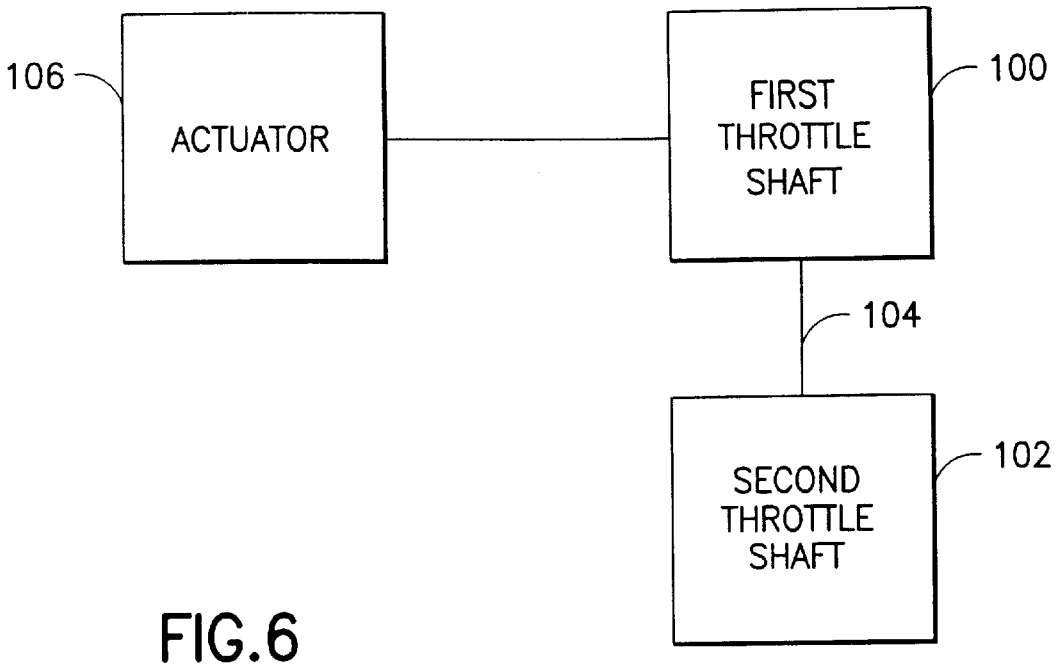
FIG. 6 is a schematic block diagram of a throttle control system of one embodiment of the present invention.
Figure 7:
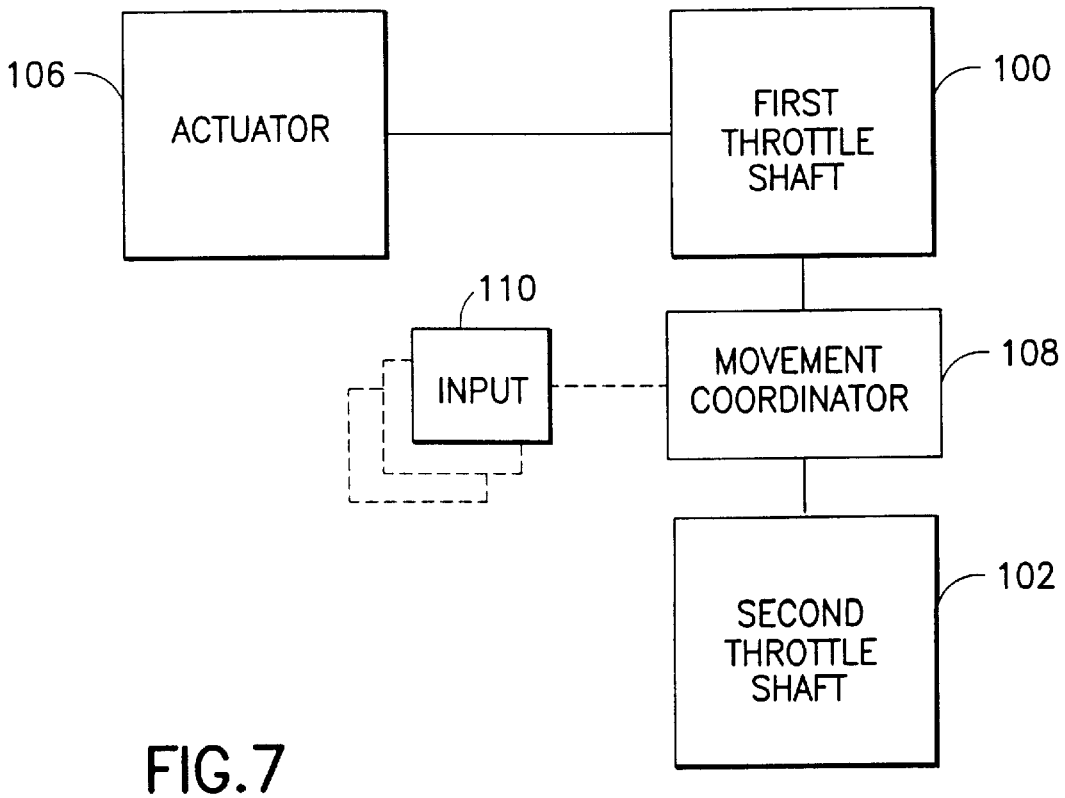
FIG. 7 is a schematic block diagram of an alternate embodiment of a throttle control system.
Figure 8:
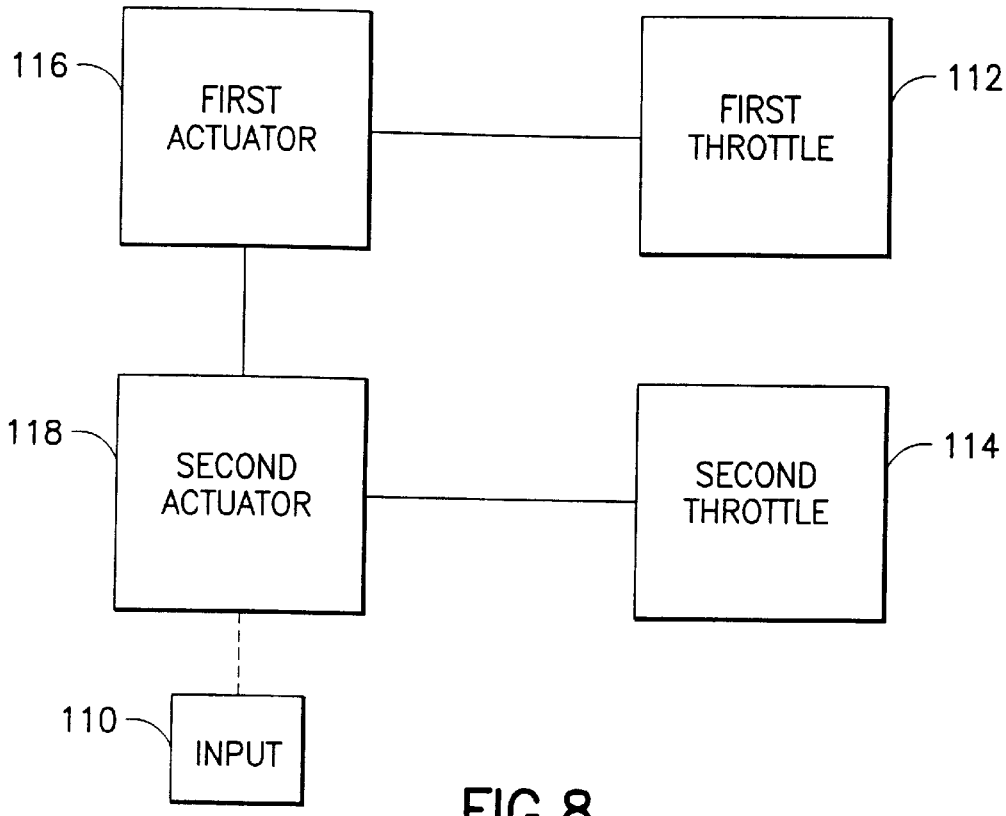
FIG. 8 is a schematic block diagram of another alternate embodiment of a throttle control system.

Referring now to FIGS. 6–11 schematic block diagrams of some variations of functional connections of two throttles or throttle shafts to each other will be described. FIG. 6 illustrates an embodiment wherein two throttle shafts 100, 102 are directly connected to each other as illustrated by line 104, and one of the shafts 100 is connected to an actuator 106. Any suitable type of direct mechanical connection 104 could be provided. In addition, any suitable type of actuator 106 could be provided, such as mechanical, electro-mechanical, electrical, and/or computer controlled. FIG. 7 illustrates an alternate embodiment wherein the two throttle shafts 100, 102 are connected to each other by a movement coordinator 108. The movement coordinator 108 could be mechanical, electro-mechanical, electrical, and/or computer controlled to provide any suitable fixed or variable patterns of relative movement of the two shafts 100, 102 relative to each other based upon predetermined information, such as speed of a vehicle using the engine and, can be connected to input(s) 110 such as a sensor(s). FIG. 8, illustrates another alternate embodiment wherein the first throttle 112 and the second throttle 114 are not directly connected to each other and, the system has two throttle actuators 116, 118. The two actuators 166, 118 are operably connected to each other. In this embodiment one of the actuators 116, 118 could move, at least partially, the other actuator. At least one of the actuators could also be connected to an input 110, such as a sensor. The actuators 116 and/or 118 could be any suitable type of actuators, such as manual, mechanical, electrical, electro-mechanical, electrical, semi-automatic or fully automatic.

Figure 9:
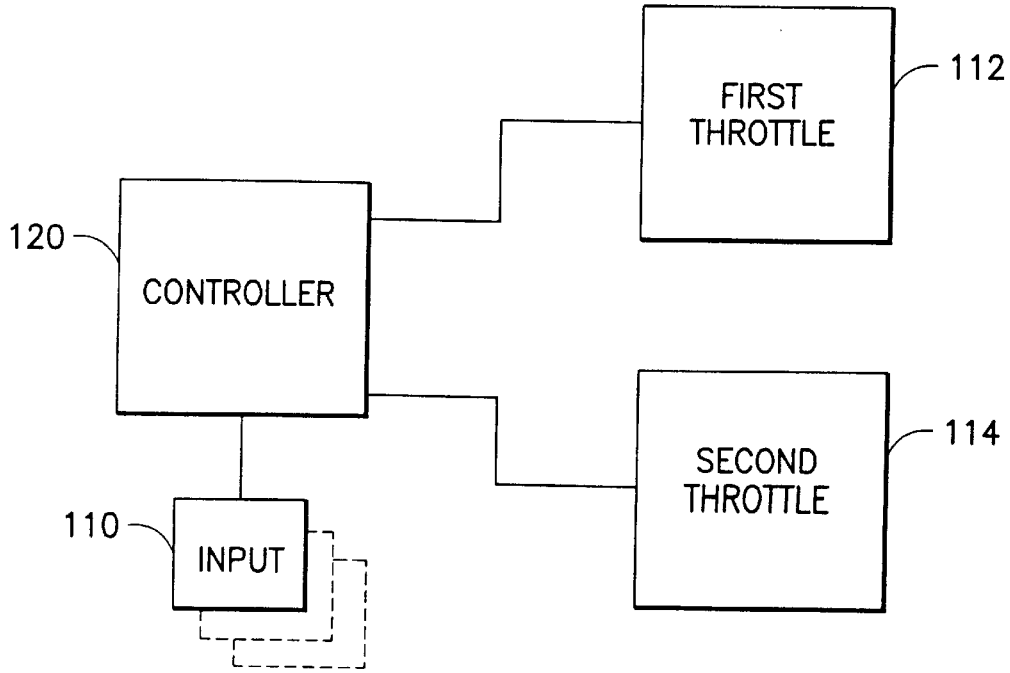
FIG. 9 is a schematic block diagram of another alternate embodiment of a throttle control system.
Figure 10:
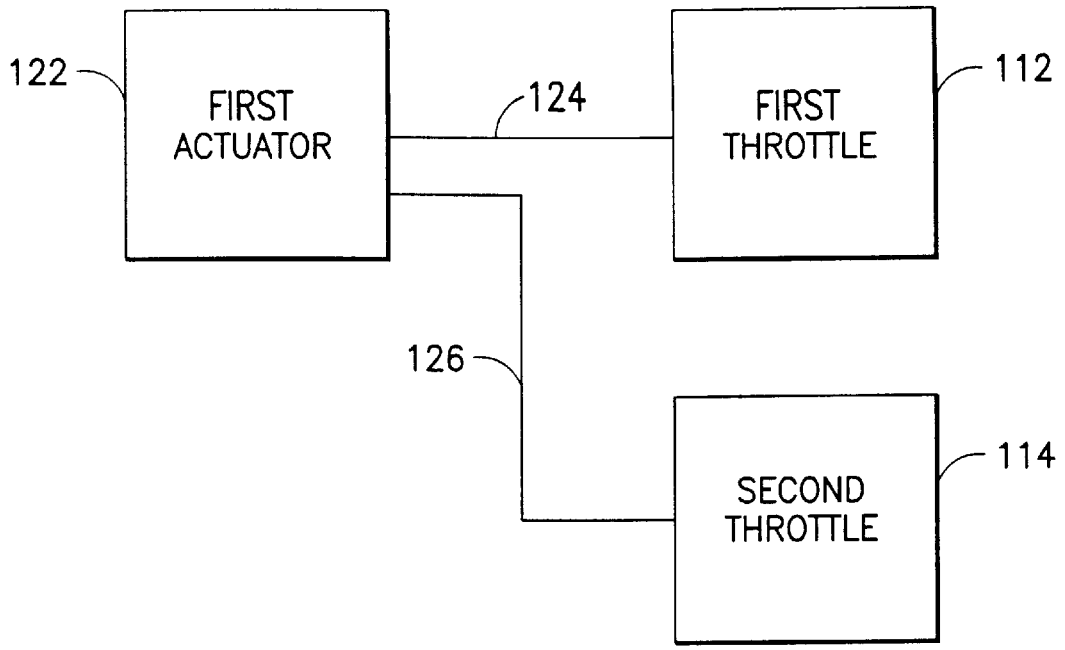
FIG. 10 is a schematic block diagram of another alternate embodiment of a throttle control system.
Figure 11:
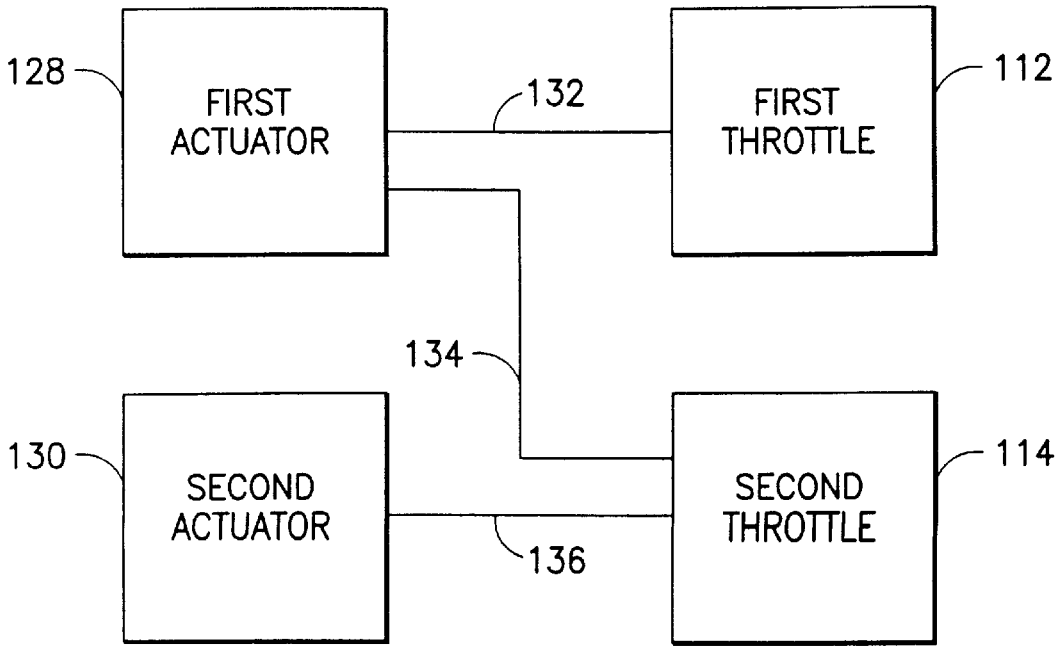
FIG. 11 is a schematic block diagram of another alternate embodiment of a throttle control system.

FIG. 9 illustrates another alternate embodiment wherein the two throttles 112, 114 are separately operably connected to a same controller 120. The controller 120 could be mechanical, electro-mechanical electrical, and/or a computer and could include one or more sensors 110. If the controller includes a computer, the computer could have suitable algorithm programming and/or a memory with preprogrammed data to move the throttles 112 and/or 114 relative to each other and/or based upon input from inputs 110. FIG. 10 illustrates another alternate embodiment wherein the two throttles 112, 114 are separately connected to a single actuator 122 as illustrated by lines 124, 126. Thus, the single actuator 122 can move both the throttles 112, 114 and the connections 124, 126 can be adapted to provide any suitable respective movements of the throttles 112, 114 relative to movement of the actuator 122. FIG. 11 illustrates another alternate embodiment wherein the system comprises two throttles 112, 114 and two actuators 128, 130. In this system the first actuator 128 is connected to both the throttles 112, 114 by two connections 132, 134. The second actuator 130 is only connected to the second throttle 114 by a connection 136. Thus, the first actuator 128 could possibly control, at least partially, both throttles 112, 144, and the second actuator 128 can at least partially control the second throttle 114.

As is known in the art for small two stroke engines, misfires (i.e.: no combustion in the combustion chamber)

can occur as much as one-third of the time. If a misfire occurs in the engine 10 a compression wave will not pass into the accumulator 34. One of the features of the present invention is that the inlet aperture 30 may be sized to prevent the accumulator 34 from totally discharging into the cylinder 12. In other words, the accumulator 34 may be pressurized for the entire time that the inlet 30 is open such that compressed air is continually exerting pressure out the inlet 30 when the inlet 30 is open. This occurs regardless of whether there has been combustion or a misfire. Since the piston head 40 opens and closes all of the ports/channels 24, 28, 30, 38, 42, the engine 10 can be designed to provide different performance characteristics by changing the positions of the ports/channels 24, 28, 30, 38, 42 relative along the length of the cylinder and/or relative to each other along the length of the cylinder. This can change the timing of how long the accumulator is charged with compressed air from the crankcase, how long the accumulator blows off, how long the accumulator injects into the cylinder, etc. This can also change pressure rate changes, such as if the transfer channel, exhaust outlet or air inlet open sooner or later in the piston cycle.

A multi throated carburetor is described for use on a stratified charge type internal combustion engine. The carburetor is most useful in application to small multi-positional two-stroke engine as utilized on handheld lawn and garden equipment.

The carburetor is designed to be constructed as a "sandwich plate" for adaptation to presently available or slightly modified carburetor bodies. The "sandwich plate" configuration is a common method of manufacture for presently available carburetors which allows each component to be fashioned as a separate plate and stacked on the base carburetor to form the entire desired unit. Thus allowing ease of manufacture with presently available methods and tooling. This adaptation to presently available carburetors and the associated tooling, provides for rapid and economic adaptation to many applications for which the base carburetor and tooling presently exists.

The secondary throat or venturi of the carburetor is located near the center of the additional sandwich plate, and this plate is mounted directly adjacent the metering chamber of the base carburetor. The metering chamber provides a supply of fuel to the venturi that is regulated to be at or near atmospheric pressure. This metering chamber may be located in the carburetor body, an adjacent sandwich plate or in the same sandwich plate as the secondary venturi. The secondary venturi is located in the center of the plate and adjacent to the metering chamber to provide for little change in fuel elevation relative to the venturi as the engine is operated in multiple positions. The small change is relative fuel position provides for reliable operation of the engine due to a relatively constant air-fuel ratio in all positions.

The secondary throat/venturi, inlet path is provided with a cylindrical fitting to facilitate ease of manufacture and assembly of the carburetor unit to the engine. The cylindrical fitting is provided with an annular groove in which to mount an O-ring rubber seal to allow sealing of the inlet to the engine. This cylindrical fitting and associated O-ring are received into an open cylindrical hole/fitting on the engine/heat dam. In this way, the fitting locates and seals the secondary throat/inlet in a plane that is perpendicular to the throat axis. The main carburetor body is then located and sealed to the engine/heat-dam on its face as is the normal practice, with a gasket and bolts. In this way the locating and sealing of the two inlet paths are on planes that are perpendicular to each other. This allows for great tolerance in the location and alignment of the two parts, thus, allowing each of economical manufacture and assembly.

The primary throat of the original carburetor may be provided with a venturi and entrance for fuel-oil mixture into that venturi. This is located in a similar fashion to the main fuel circuit in the present carburetor. This inlet can then be utilized to provide a portion of the fuel-oil mixture into the crankcase of the engine for lubricating the components therein. Further, since the inlet is located in a venturi that is controlled by the main throttle of the engine, the lubrication is supplied in proportion to the load on the engine. This proportioning matches the lubrication requirement of the engine, i.e., more lubrication required at higher loads.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. In an internal combustion engine having a crankcase, a cylinder connected to the crankcase, a compressed air assisted fuel injection system connected between the crankcase and the cylinder, and a reciprocating piston head located in the cylinder, wherein the improvement comprises:

a fuel delivery system having two carburetor sections with two interconnected rotatable shafts, wherein a first one of the carburetor sections has an outlet in communication with the crankcase for delivering air to the crankcase, and wherein a second one of the carburetor sections has an outlet in communication with the cylinder for delivering a fuel and air mixture into the cylinder without passing the fuel and air mixture through the crankcase.

2. An internal combustion engine carburetion system comprising:

a frame having two air flow channels;

two throttle shaft assemblies connected to the frame and extending into respective ones of the air flow channels; and a movement system for moving the two throttle shaft assemblies, the movement system being adapted to rotate both of the throttle shaft assembles at a same time for a majority of angular rotations of the two throttle shaft assemblies wherein the two throttle shaft assemblies each have a shaft which are angled at an acute angle relative to each other.

3. A carburetion system as in claim 2 wherein the movement system comprises the two throttle shaft assemblies being movably directly connected to each other.

4. A carburetion system as in claim 2 wherein the frame comprises at least two frame pieces, each of the frame pieces having a respective one of the air flow channels therein.

5. A carburetion system as in claim 2 wherein the movement system comprises a movement coordinator between the two throttle shaft assemblies for rotating a second one of the throttle shaft assemblies in predetermined degrees of angular rotation based upon angular rotation of a first one of the throttle shaft assemblies.

6. A carburetion system as in claim 5 wherein at least one angle of rotation of the first shaft assembly does not have an equal angle of rotation of the second shaft assembly.

7. An internal combustion engine carburetion system comprising:

a frame having two air flow channels;

two throttle shaft assemblies connected to the frame and extending into respective ones of the air flow channels; and a movement system for moving the two throttle shaft assemblies, the movement system being adapted to rotate both of the throttle shaft assembles at a same time for a majority of angular rotations of the two throttle shaft assemblies wherein ends of the two throttle shaft assemblies are directly connected to each other by a connection at the ends.

8. An internal combustion engine carburetion system comprising:

a frame having two air flow channels;

two throttle shaft assemblies connected to the frame and extending into respective ones of the air flow channels; and a movement system for moving the two throttle shaft assemblies, wherein the frame comprises at least two frame pieces, each of the frame pieces having a respective one of the air flow channels therein, and wherein the two frame pieces form a fuel metering chamber therebetween.

9. An internal combustion engine carburetion system comprising:

a frame having two air flow channels;

two throttle shaft assemblies connected to the frame and extending into respective ones of the air flow channels; and a movement system for moving the two throttle shaft assemblies, the movement system being adapted to rotate both of the throttle shaft assembles at a same time for a majority of angular rotations of the two throttle shaft assemblies, wherein the frame comprises at least two frame pieces, each of the frame pieces having a respective one of the air flow channels therein, and wherein a second one of the frame pieces has a fitting at a side of the first frame piece, the fitting having a conduit therethrough connected with a second one of the air flow channels.

10. An internal combustion engine carburetion system comprising:

a frame having two air flow channels;

two throttle shaft assemblies connected to the frame and extending into respective ones of the air flow channels; and a movement system for moving the two throttle shaft assemblies, the movement system being adapted to rotate both of the throttle shaft assembles at a same time for a majority of angular rotations of the two throttle shaft assemblies, wherein the movement system comprises two drives for respectively moving the two throttle shaft assemblies.

11. A carburetion system as in claim 10 wherein a second one of the drives moves a second one of the throttle shaft assemblies at least partially based upon engine speed or engine load produced by position of a first one of the throttle shaft assemblies.

12. An internal combustion engine carburetion system comprising:

a frame having two air flow channels;

two throttle shaft assemblies connected to the frame and extending into respective ones of the air flow channels; and a movement system for moving the two throttle shaft assemblies, the movement system being adapted to rotate both of the throttle shaft assembles at a same time for a majority of angular rotations of the two throttle shaft assemblies, wherein the movement system comprises a computer controller for moving the two throttle shaft assemblies in predetermined positions or rotations relative to each other.

13. An internal combustion engine carburetion system comprising:

a frame having two air flow channels;

two throttle shaft assemblies connected to the frame and extending into respective ones of the air flow channels;

a movement system for moving the two throttle shaft assemblies, the movement system being adapted to rotate both of the throttle shaft assembles at a same time for a majority of angular rotations of the two throttle shaft assemblies; wherein the movement system comprises a controller for moving the two throttle shaft assemblies in predetermined positions or rotations relative to each other, and a sensor connected to the controller for sensing a predetermined characteristic of an engine or device the engine is attached to.

14. A method of assembling a carburetor for an internal combustion engine comprising steps of:

providing a frame having two air flow channels through the frame, the frame having a fuel conduit system for supplying fuel to the two air flow channels;

connecting two control shaft assemblies to the frame, a first one of the shaft assemblies extending into a first one of the air flow channels; and operably connecting the two control shaft assemblies to each other to coordinate movement of a second one of the shaft assemblies at least partially relative to movement of the first shaft assembly, wherein movement of the second shaft assembly at least partially controls supply of fuel delivery to a second one of the air flow channels, and wherein movement of the first shaft assembly from a first idle position to a second wide open throttle position has a coordinated movement of the second shaft assembly for a majority of angular rotation of the first and second shaft assemblies from a first small or no fuel supply delivery position into the second air flow channel to a second relatively larger fuel supply delivery position with fuel delivery from the fuel conduit system being switched, at least partially, from the first air flow channel to the second air flow channel by changes in vacuum pull in the first and second air flow channels when the two control shafts are moved between their respective first and second positions.

15. A method as in claim 14 wherein the step of providing the frame comprises attaching a first frame piece having the first air flow channel to a second frame piece having the second air flow channel.

16. A method as in claim 14 wherein the step of operably connecting the two control shaft assemblies to each other comprises rotatably connecting two ends of the control shaft assemblies to each other.

* * * * *